US005465698A

United States Patent [19]

Benholz

[11] Patent Number: 5,465,698

[45] Date of Patent: Nov. 14, 1995

[54] MEMBRANE CARBURETOR

[75] Inventor: Martin Benholz, Oppenweiler, Germany

[73] Assignee: Andreas Stihl, Waiblingen, Germany

[21] Appl. No.: 294,834

[22] Filed: Aug. 29, 1994

[51] Int. Cl.[6] ..... F02M 7/12

[52] U.S. Cl. ..... 123/38

[58] Field of Search ..... 123/438, 437, 123/441; 260/35, 69.1, 69.2, DIG. 68

[56] References Cited

U.S. PATENT DOCUMENTS

| | | | |
|---|---|---|---|
| 4,726,342 | 2/1988 | Diener | 123/438 |
| 4,787,356 | 11/1988 | Rösgen et al. | 123/438 |
| 4,944,272 | 7/1990 | Carlsson et al. | 123/438 |
| 4,949,692 | 8/1990 | Devine | 123/438 |
| 5,345,912 | 9/1994 | Svensson et al. | 123/438 |

*Primary Examiner*—Raymond A. Nelli
*Attorney, Agent, or Firm*—Walter Ottesen

[57] ABSTRACT

The invention is directed to a membrane carburetor for changing the air/fuel ratio. The membrane carburetor achieves the same result as previous carburetors but at a greater insensitivity to wear and disturbances as well as an improved controllability in a constructively simpler and more compact manner. The carburetor includes a coil arranged about a valve needle so that the coil and the valve needle conjointly define a solenoid actuator. The valve needle is the armature of the solenoid actuator. When a limit rpm is reached, the coil is activated by a current and the armature is raised and thereby a greater flow of fuel is made possible. The enrichment of the air/fuel mixture achieved in this manner limits the engine rpm. The membrane carburetor wherein the air/fuel ratio can be changed is for an internal combustion engine of a portable handheld apparatus such as a motor-driven chain saw, hedge clippers and the like.

6 Claims, 1 Drawing Sheet

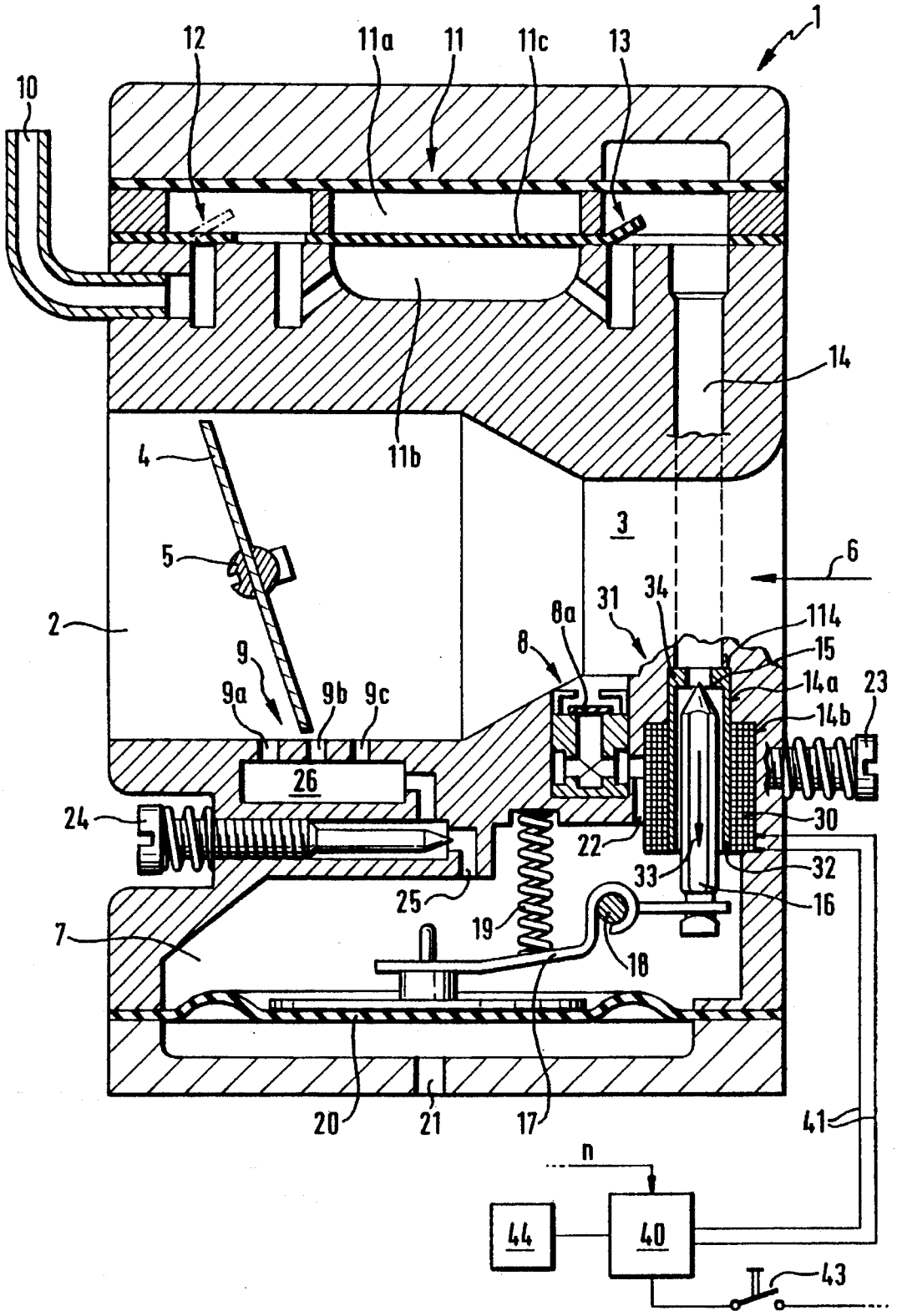
1
10
12
11a
11
11c
13
14
11b
4
3
5
6
2
31
34
114
8a
8
15
9
14a
23
9a
9b
9c
14b
26
24
30
22
32
33
25
16
19
7
18
20
21
17
41
n
44
40
43

MEMBRANE CARBURETOR

FIELD OF THE INVENTION

The invention relates to a membrane carburetor for an internal combustion engine of a work apparatus such as a motor-driven chain saw, hedge clippers and the like. The carburetor includes a control chamber delimited by a control membrane to which fuel is metered via a control valve. The control membrane actuates a controller lever which, in turn, holds a valve needle of the control valve and, with a solenoid actuator, opens the inlet valve. The solenoid actuator includes a coil and an armature.

BACKGROUND OF THE INVENTION

U.S. Pat. No. 4,787,356 discloses a carburetor of this kind wherein the rpm of the engine, such as a two-stroke engine, is controlled when reaching a limit rpm by enriching the mixture in such a way that an overpressure acts on the control membrane with the overpressure being derived from an engine blower spiral or an engine muffler. The control membrane acts in opposition to the force of a spring by means of a centrally mounted pin on a carburetor regulating membrane. The carburetor regulating membrane opens a valve needle via a lever mechanism and thereby permits the flow of fuel into a pressure chamber. The force transmitted by the pin of the control membrane is directed via a bolt, which is mounted on the control membrane, to a free leg of a Z-shaped pivotally journalled transmitting lever and pivots the transmitting lever against the force of a spring. The other end of the transmitting lever is attached to a valve needle which blocks the throughflow of fuel. The valve needle is lifted from its valve seat by the pivoting of the Z-shaped transmitting lever and permits an increased enrichment of the air/fuel mixture via the fuel which now flows. The rpm drops with the enrichment of the mixture. A specific limit rpm cannot be exceeded.

Furthermore, the engine is cooled in the critical range (that is, high rpm and high temperature) additionally by the vaporization enthalpy of the fuel and is lubricated by the oil contained in the fuel.

As further described in U.S. Pat. No. 4,787,356, the arrangement is equipped with a solenoid actuator mounted on the dry side of the carburetor regulating membrane as an alternative to the control via the overpressure-dependent control membrane. The armature of the solenoid actuator acts via the control membrane on the lever mechanism described above and thereby opens the valve. The solenoid actuator is supplied with electrical voltage proportional to rpm. This causes a larger fuel throughflow and therefore an enrichment of the mixture. This, in turn, achieves a throttling of the engine and a specific limit rpm is not exceeded. It is a disadvantage in this arrangement that the solenoid actuator is mounted on the dry side of the regulating membrane. This causes more space to be needed for mounting the solenoid actuator and the carburetor housing must be correspondingly increased.

Both of the above-mentioned arrangements are in addition disadvantageous in that the long transmitting path defined by control member, carburetor membrane and transmitting lever requires a great many parts which must be mechanically or electromechanically moved. On the one hand, this causes a greater inertia of the system and, on the other hand, the inherent elasticity of the transmitting members as well as play and slack between two transmitting members cause additional delays which are in opposition to a desired precise control, The configuration of these devices for limiting speed is most complex and very sensitive to disturbance.

SUMMARY OF THE INVENTION

It is an object of the invention to provide a membrane carburetor which is so improved that a highly precise and functionally reliable intervention in the control characteristic is ensured without increasing the structural length and the structural volume of the carburetor.

The membrane carburetor of the invention is for an internal combustion engine of a work apparatus such as a motor-driven chain saw, hedge trimmer or the like. The membrane carburetor includes: a carburetor housing having an interior space; a movable regulating membrane mounted in the space so as to partition the same into a control chamber on one side of the membrane and into an additional chamber on the other side of the membrane; a fuel channel communicating with the control chamber; a valve seat in the fuel channel; a valve needle mounted in the control chamber to define a valve with the valve seat; a control lever pivotally mounted in the control chamber and connected to the regulating membrane and to the valve needle so as to permit the membrane to actuate the valve needle; a solenoid for moving the valve needle away from the valve seat thereby opening the valve to permit fuel to enter the control chamber; and, the solenoid including a coil mounted in the region of the valve and an armature defined by the valve needle.

A solenoid actuator is arranged as a control element in such a manner that the coil body of the solenoid actuator is disposed in a widening of the fuel channel and that the armature of the solenoid actuator is defined by the valve needle.

In this arrangement, it has been shown advantageous that the control element, that is the solenoid actuator, is disposed in the wet space of the control chamber. The arrangement is thereby more insensitive to dirt and wear than in an arrangement wherein the actuator element is disposed on the dry side of the control membrane and is subjected to environmental influences which can, for example, lead to corrosion.

It is furthermore advantageous that the compact, cost effective assembly of the actuator element requires less movable parts for transmitting the actuating variable. Forces to be transmitted are transmitted precisely and without delay. No additional space for building in the actuator element is needed because of the integrated compact assembly.

A further advantage is that various control strategies and characteristics can be developed because of the excellent controllability. For example, the opening operation of lifting up the valve needle from the valve seat takes place in accordance with a specific characteristic in dependence upon rpm in a pregiven rpm range. A further advantageous application is to use the control valve in lieu of a choke flap.

BRIEF DESCRIPTION OF THE DRAWING

The invention will now be described with respect to the single FIGURE of the drawing which shows a membrane carburetor according to the invention having an electrically actuable control valve.

DESCRIPTION OF THE PREFERRED EMBODIMENTS OF THE INVENTION

The carburetor 1 has an intake channel 2 having a venturi section 3. A throttle flap 4 is mounted in the intake channel 2 and is pivotally held by a pivot pin 5 in the intake channel. The carburetor shown communicates with the intake channel of an internal combustion engine (not shown) such as a two-stroke engine. The required combustion air is drawn in by suction via the venturi section 3 in the flow direction 6.

The carburetor is connected to a fuel tank (not shown) via fuel line 10. A membrane pump 11 is provided for pumping the fuel into a control chamber 7 of the carburetor. The work chamber 11*a* of the membrane pump 11 is connected via a line (not shown) to the crankshaft housing of the internal combustion engine or two-stroke engine so that the membrane pump 11 is driven by the changing crankcase pressure. The membrane 11*c* is deflected in the direction toward the work chamber 11*a* when there is an underpressure in the crankcase so that an underpressure develops in the pump chamber 11*b* and fuel is drawn in through check valve 12 via the fuel line 10. The check valve 12 is configured as a flap valve. The membrane 11*c* is deflected in the direction toward the pump chamber 11*b* when their is an overpressure in the crankcase. For this reason, the check valve 12 closes and the check valve 13 opens. The check valve 13 is likewise configured as a flap valve. The fuel is pumped into a fuel channel 14 via the open check valve 13 and the fuel channel 14 opens via a control valve into the control chamber 7.

The control valve 31 comprises a valve needle 16 which is configured to be conical at one end and a valve seat is provided for the valve needle. The other end of the valve needle 16 is supported on a lever arm 17. The lever arm 17 is pivotally held in the control chamber 7 by a bearing pin 18. A control spring 19 configured as a compression spring resiliently biases the valve needle 16 in the direction of closure. In addition, the control spring 19 holds the free end of the lever 17 against a stop in the center of the regulating membrane 20 which delimits the control chamber 7. The dry side of the membrane 20 faces away from the control chamber and is subjected to atmospheric pressure. An opening 21 is provided in the membrane cover for this purpose.

The control chamber 7 is filled with fuel and is connected via a first channel 22 directly to a main nozzle 8 which opens into the intake channel 2 in the region of the venturi section 3. The main nozzle 8 is provided with a check platelet 8*a* which prevents the pressure relationships in the intake channel 2 from acting on the control chamber 7. The passthrough cross section of the connecting channel 22 can be changed by an adjusting screw 23 so that the fuel flow from the control chamber 7 to the main nozzle 8 is adjustable.

The control chamber 7 is connected via a second connecting channel 25 to an idle chamber 26 in correspondence to the configuration of an independent idle system. An idle outlet bore 9*a* leads into the intake channel 2 from the idle chamber 26. For the idle position of the throttle flap 4 shown, the bore 9*a* lies rearward of the throttle flap 4 viewed from the venturi section 3 in the flow direction 6 of the intake air; whereas, the idle venting bores 9*b* and 9*c* (viewed in the same direction) are located forward of the throttle flap 4. The pass-through cross section of the second connecting channel 25 is likewise changeable via an idle adjusting screw 24.

In idle operation, fuel enters into the idle chamber 26 via the connecting channel 25 in correspondence to the adjustment of the idle screw 24; whereas, air enters via bores 9*b* and 9*c* and mixes with the fuel in the idle chamber 26. The fuel/air emulsion exits via the idle outlet bore 9*a* into the intake channel 2. When the throttle flap 4 opens, the idle bores 9*b* and 9*c* sequentially come into the Underpressure region so that fuel enters into the intake channel 2 also through these bores. When the throttle flap 4 is fully open, an underpressure builds up in the venturi section 3 because of the flow velocity of the inducted air so that fuel exits mostly from the main nozzle 8 into the intake channel 2. An underpressure, which builds up in the control chamber 7, is compensated by opening the control valve 31 and the fuel which then flows.

In the embodiment shown, the control valve 31 is configured as an electromagnetically actuable valve. For this purpose, a coil 30 is mounted in the carburetor housing 1 and surrounds the valve needle 16. The valve needle 16 is configured to be axially longer than the coil 30 so that both ends of the valve needle 16 project axially out of the coil 30. It is preferable to mount the coil 30 on a coil carrier 32 which is extended at one axial end 34 and defines the valve seat 15. The coil carrier 32 is preferably made of a nonmagnetic material; whereas, the valve needle 16 is of a soft-magnetic body.

The coil 30 and the coil carrier 32 are mounted in the housing of the carburetor 1. For this purpose, the fuel channel 14 is configured to be widened in diameter at its end facing toward the control chamber 7. Preferably, the channel 14 is configured to be widened in diameter in a first section 14*a* for receiving the coil carrier 32. The coil carrier 32 then is supported axially on the shoulder 114 in the fuel channel 14. The shoulder 114 is formed by the widening.

An end section 14*b*, which is again widened in diameter and is axially open to the control chamber, extends from the expanded end section 14a of the channel 14. The expanded end section 14*b* receives the coil 30 which is cast especially in the end section 14*b*. The arrangement of the coil 30 and the coil carrier 32 in the fuel-conducting chamber of the carburetor protects the electromagnetic control valve against dirt, corrosion or the like. The control characteristic of the membrane carburetor is not affected when the coil current is switched off so that the operation described above is ensured.

The coil connections 41 brought out of the housing of the carburetor 1 are connected to the output of a control 40 which, for example, monitors the rpm (n) of the two-stroke engine. If the rpm (n) reaches a pregiven limit rpm, then an electric current is applied to the coil 30 which is so directed that the electromagnetic field which builds up displaces the valve needle 16 in the opening direction (arrow 33). The valve needle 16 lifts up from the valve seat 15 so that the fuel present under slight pressure in the fuel channel 14 floods into the control chamber 7 and increasing quantities of fuel enter the intake channel 2 via the main nozzle 8 and the idle nozzle 9. The mixture becomes enriched causing the rpm (n) to drop. If the actual rpm drops below the pregiven limit rpm, then the control 40 switches the electric current off and, for this reason, the valve needle 16 is pressed by the pressure of the control spring 19 onto the valve seat 15 in a direction opposite to arrow 33. The control valve 31 only opens again when the control valve is actuated by the regulating membrane 20 via the lever 17.

An actuation of the electromagnetic control valve 31 in the opening direction 33 can also take place via the control 40 when an electric contact 43 is closed. This can, for example, take place during the starting operation so that an enrichment of the mixture takes place by opening the control valve accompanied by a moderate flooding of the control chamber 7. A choke flap in the intake channel which would otherwise be necessary can therefore be omitted.

In another embodiment of the invention, the control 40 can be connected to an operating data memory 44 in order to intervene in a specific manner in the control characteristic of the membrane carburetor in dependence upon the rpm (n). In this way, and for a particular rpm, an opening (also a partial opening) of the control valve 31 can be pregiven by controlling the current through the coil 30 in order to obtain an enrichment of the mixture or a leaning of the mixture in very specific rpm ranges.

It is understood that the foregoing description is that of the preferred embodiments of the invention and that various changes and modifications may be made thereto without departing from the spirit and scope of the invention as defined in the appended claims.

What is claimed is:

1. A membrane carburetor for an internal combustion engine of a work apparatus such as a motor-driven chain saw, hedge trimmer or the like, the membrane carburetor comprising:

a carburetor housing having an interior space;

a movable regulating membrane mounted in said space so as to partition the same into a control chamber on one side of said membrane and into an additional chamber on the other side of said membrane;

a fuel channel communicating with said control chamber;

a valve seat in said fuel channel;

a valve needle mounted in said control chamber to define a valve with said valve seat;

a control lever pivotally mounted in said control chamber and connected to said regulating membrane and to said valve needle so as to permit said membrane to actuate said valve needle;

a solenoid for moving said valve needle away from said valve seat thereby opening said valve to permit fuel to enter said control chamber; and, said solenoid including a coil mounted in the region of said valve and an armature defined by said valve needle.

2. The membrane carburetor of claim 1, said housing having a bore formed therein and said coil being seated in said bore.

3. The membrane carburetor of claim 2, said coil being pressed into said bore.

4. The membrane carburetor of claim 3, said solenoid further including a coil carrier for carrying said coil, said carrier being fitted in said bore and said carrier having a base wall at one longitudinal end thereof; and, said base wall being configured to define said valve seat.

5. The membrane carburetor of claim 1, said coil defining a longitudinal axis and said valve needle being movable along said axis; and, means connected to said coil to move said valve needle through a stroke along said axis which can be adjusted in dependence upon an operating variable of said internal combustion engine.

6. The membrane carburetor of claim 1, said solenoid being mounted in said control chamber.

* * * * *